United States Patent [19]

Grantham

[11] Patent Number: 5,041,193

[45] Date of Patent: Aug. 20, 1991

[54] ACITNIDE RECOVERY

[75] Inventor: LeRoy F. Grantham, Calabasas, Calif.

[73] Assignee: Rockwell International Corporation, El Segundo, Calif.

[21] Appl. No.: 414,570

[22] Filed: Sep. 29, 1989

[51] Int. Cl.[5] ..... C25C 3/34

[52] U.S. Cl. ..... 204/1.5; 423/251; 423/253; 423/DIG. 12; 264/0.5; 75/397; 75/399; 376/201; 376/315; 376/322

[58] Field of Search ..... 204/1.5, 64 R; 75/393, 75/397, 399; 423/261, 251, D12; 376/315, 322, 201; 264/0.5; 252/627

[56] References Cited

U.S. PATENT DOCUMENTS

| | | | |
|---|---|---|---|
| 3,294,493 | 12/1966 | Jonke et al. | 423/4 |
| 3,314,865 | 4/1967 | Kleinpeter et al. | 204/1.5 |
| 3,483,913 | 12/1969 | Grosvenor et al. | 75/393 |
| 4,297,174 | 10/1981 | Brambilla et al. | 204/1.5 |
| 4,331,618 | 5/1982 | Hoyt | 264/0.5 |
| 4,880,506 | 11/1989 | Ackerman et al. | 204/1.5 |

*Primary Examiner*—Brooks H. Hunt
*Assistant Examiner*—Ngoclan T. Mai
*Attorney, Agent, or Firm*—H. Fredrick Hamann; Harry B. Field; David C. Faulkner

[57] ABSTRACT

Actinides metals are recovered from spent nuclear fuel oxides containing fission products by a pyrochemical process. The process comprises, in part, electrorefining the metal complex from an anode by electrolytically oxidizing actinides into a salt and then electrodepositing actinides onto a cathode to form an actinide metal deposit. The actinide metal deposit is then melted to separate the salts and the actinide metals. The separated salt is recycled into an electrorefiner and the actinide metals are recovered and then transferred to a fuel fabrication system.

4 Claims, No Drawings

ACITNIDE RECOVERY

BACKGROUND OF THE INVENTION

1. Technical Field

This invention relates to a process for recovering actinide elements from radioactive waste solutions derived from the reprocessing of irradiated nuclear reactor fuel.

2. Background Art

One of the major problems confronting the nuclear power industry is management of the highly radioactive liquid waste which results from the reprocessing of irradiated nuclear reactor fuel.

Disposal of radioactive waste, in general, cannot be readily accomplished by using conventional waste disposal techniques because of the relatively long half-lives of certain radioactive elements. The most widely used disposal technique for radioactive waste are storage, solidification and burial.

Further, no process has been devised which will separate actinides from spent nuclear oxide fuel so that assurance of waste management and environmental isolation for reasonable times is available.

It is accordingly an object of this invention to provide a process which is capable of partitioning actinides from spent fuel for subsequent reprocessing.

Another object of the invention is to provide a cost-effective process for safe disposition of these waste products with energy recovery.

Other objects and advantages of this invention will become apparent in the course of the following detailed description.

DISCLOSURE OF INVENTION

The present invention provides a pyrochemical process for producing non-transuranic waste from spent light water reactor fuel and reprocessing same into useful products.

The pyrochemical process according to the present invention comprises (i) conversion of a spent fuel oxide into a finely divided powder, (ii) reduction of the powder fuel oxide to a metal complex, (iii) electrorefining the metal complex to electrolytically oxidize the actinides from an anode into the salt and electrodepositing the actinide from the salt onto a cathode, (iv) recovering the purified actinides from the cathode for reactor recycle, and (v) managing the waste by recovery and recycle of components, preparing waste forms, packaging, storage, and waste disposal at proper low level waste or repository sites.

DETAILED DESCRIPTION

The process of the present invention accomplishes waste removal and reprocessing by initially converting the spent oxide reactor fuel in the form of pellets into pulverized powder by sequentially oxidizing with air to form expanded $U_3O_8$ and then reducing with hydrogen to reform $UO_2$ according to the following reaction scheme:

$$3UO_2(\text{fuel}) + O_2 \underset{}{\overset{400^\circ\ C.}{\rightleftharpoons}} U_3O_8$$

-continued $$U_3O_8 + 2H_2 \overset{600^\circ\ C.}{\rightleftharpoons} 3UO_2 + 2H_2O$$

Hydrogen concentrations using an inert gas are kept below the explosion limit so this reductant can be safely used in a fuel processing facility. The oxidization of the uranium dioxide to the $U_3O_3$ results in a 30 percent volume expansion. Reduction followed by reoxidation continues to pulverize the fuel pellets through volume expansion during oxidation. Three oxidation-reduction cycles produce a powder with 96 percent of the particles being less than 200 mesh. The pulverization of the fuel allows it to flow from the cladding which ruptured during oxidation. The cladding of the spent fuel rod is removed as a transuranic waste and simultaneously the inert gases, krypton and xenon are cryogenically removed, distilled and bottled. Tritium is oxidized to tritium oxide, condensed and incorporated into concrete for disposal. Iodine, strontium and cesium are retained as a salt waste product.

The next step in the pyrochemical process is the reduction step which is carried out electrolytically to produce molten metal from the oxides. The pulverized decladded oxide fuel is dissolved in a molten fluoride salt and electrolytically reduced to metal. The carbon of a consumable graphite anode is oxidized to carbon dioxide while the dissolved uranium dioxide and plutonium dioxide and all the non-plutonium transuranic oxides except possible some americium are electro-chemically reduced to the molten actinide metal at the cathode at about 1200° C. The molten metal is cast into electrorefining anode feed stock. The rare earths and other active fission products such as cesium and strontium and any remaining actinides such as americium are transferred to the salt. The salt is further processed as described in more detail hereinbelow, to remove the americium and to convert the waste salt to a non-transuranic salt.

Alternatively the pulverized oxide fuel containing the actinide can be converted to a metal by chlorination and chemical reduction. The solid oxide is converted to a solid chloride by contacting with a gaseous chlorinating agent such as 80 volume % chlorine, 20 volume % carbon tetrachloride catalyst. Other known chlorinating techniques could be used, however chlorine-carbon tetrachloride chlorination is particularly desirable since it minimizes waste and minimizes use of or generation of hazardous products such as phosgene. The chloride containing the actinide is then dissolved in a molten salt solvent such as the eutectic mixture of LiCl-KCl and reduced by contacting with lithium-potassium metal dissolved in molten cadmium. The molten solvent salt (electrolyte) containing the actinide must be well mixed with the molten cadmium reductant to force the reduction to completion. This converts the actinides and less active metals to the metal which is dissolved in the molten cadmium while the lithium-potassium is oxidized to chloride and adds to the molten chloride solvent. This metal-cadmium mixture containing the actinides is used as the cathode feed during electrorefining.

Following the electrolytic or chemical reduction steps discussed above, the cast anode feed stock from the electroreduction step is dissolved in molten cadmium at about 500° C. This molten cadmium anode and an inert solid cathode are contained in a suitable reaction vessel containing a molten electrolyte solvent. A particularly well-suited electrolyte is LiCl-KCl eutectic which is liquid at above 360° C. The actinides are electrolytically oxidized from the anode and drawn through the electrolyte before being reductively deposited on the cathode. The less active fission products remain in the anode while the more active fission products such as the rare earths remain in the salt. The electrolytic transfer of actinide from anode to cathode permits partitioning of the actinides from the remainder of the waste. This also separately recovers a uranium product and a plutonium-rich product. The uranium product is enriched if necessary and the uranium and plutonium-rich product are fabricated into nuclear reactor fuel. The fuel is then fissioned in a reactor to generate power from the spent fuel waste product.

Following the electrorefining step, the actinide deposited on the cathode is melted away from the cathode and allowed to "freeze" or solidify and the salt is then separated from the metal. The salt is recycled to the electrorefiner and the uranium and plutonium-rich ingots are transferred to the fuel fabrication system where recycle fuel is produced for the reactor.

The fuel fabrication methods depend upon the type of fuel used in the reactor. The existing commercial reactors in the United States are oxide fueled reactors. Thus for existing commercial reactors, the metal from electrorefining must be converted to an oxide before fabrication into fuel rods and assembled into fuel assemblies.

The metal fuel is steam oxidized to oxide. It is subsequently pressed into pellets, sintered, and loaded into cladding with the bottom end cap in place. After loading, the top end cap is welded onto the fuel pin to isolate the fuel from the environment. After decontamination, these pins are loaded into fuel assemblies and the end hardware is installed on the fuel bundle. The fuel assembly is checked to determine that fuel specifications are met and transferred to the reactor.

At the oxide fuel reactor the actinides in the fuel are fissioned while the reactor is producing power. Eventually the fuel becomes depleted in fissile actinides so that it must be replaced. The spent fuel is then reprocessed after a period in storage to allow the short half-lived fission products to decay.

Metal fueled experimental fast reactors require metal fuel. The metal fuel for these reactors is fabricated as follows. The actinide metal ingots from electrorefining are melted and cast into long slender pins which are loaded into cladding. The cladding is sealed by welding the end cap in place and the rods are assembled into fuel assemblies. The fuel assemblies are then cycled to the reactor for fissioning of the actinides.

The waste salt from the electroreducer or the electrorefiner is combined with a lithium-cadmium alloy which causes the actinides to be reduced chemically to a metal moiety which is then recycled to the anode in the electrorefiner. Cadmium chloride is then added to the salt to remove excess lithium; the metal extraction process being repeated about three times. The resulting transuranic residue is recycled to the anode of the electrorefiner where the actinides are transferred to the cathode and ultimately recycled to a reactor for consumption by fissioning.

While the principle preferred embodiment has been set forth, it should be understood that in the scope of the appended claims, the invention may be practiced otherwise than specifically described.

What is claimed and desired to be secured by Letters Patent of the United states is:

1. A pyrochemical process for the recovery of actinides from spent nuclear fuel oxides containing fission products comprising:

(i) converting the spent nuclear fuel oxide into a finely divided powder;

(ii) converting the powdered fuel oxide to a metal complex at an anode;

(iii) electrorefining the metal complex by electrolytically oxidizing actinides from the anode into a salt electrolyte;

(iv) electrodepositing the actinides from the salt electrolyte onto cathode to form an actinide metal deposit;

(v) melting the actinide metal deposit;

(vi) separating the salts and actinide metals; and (vii) recovering the actinide metals.

2. The process of claim 1 further comprising:

(i) recycling the separated salt into an electrorefiner; and (ii) transferring plutonium and uranium moieties to a fuel fabrication system.

3. The process of claim 1 wherein the conversion of the powdered fuel oxide to a metal complex is an electrolytic reduction.

4. The process of claim 1 wherein the conversion of the powdered fuel oxide to a metal complex is by chlorination and chemical reaction.

* * * * *